United States Patent [19]

Massoudi

[11] Patent Number: 5,002,434

[45] Date of Patent: Mar. 26, 1991

[54] METHOD AND APPARATUS FOR PLACING A HOLLOW COLUMN IN THE HARD BOTTOM OF A BODY OF WATER IN PARTICULAR IN A ROCK BOTTOM

[75] Inventor: Ahmad Massoudi, Tehran, Iran

[73] Assignee: Darya Paye Jetty Co., Ltd., England

[21] Appl. No.: 401,026

[22] Filed: Aug. 31, 1989

[30] Foreign Application Priority Data

Sep. 2, 1988 [NL] Netherlands ..... 8802176

[51] Int. Cl.[5] ..... E02D 29/06; E02D 7/28; E02B 3/06

[52] U.S. Cl. ..... 405/226; 405/133; 405/195; 405/248; 405/204; 37/58

[58] Field of Search ..... 405/195, 203, 204, 205, 405/224, 226, 133, 248; 37/56, 58, 59, 61

[56] References Cited

U.S. PATENT DOCUMENTS

| | | | |
|---|---|---|---|
| 1,907,854 | 5/1933 | Moran . | |
| 2,023,686 | 12/1935 | Kertzman | 37/58 |
| 2,992,497 | 7/1961 | Davis | 37/58 |
| 3,106,068 | 10/1963 | Beckenbauer et al. | 405/133 X |
| 3,171,219 | 3/1965 | Kaufmann et al. | 37/56 |
| 4,036,161 | 7/1977 | Nixon | 405/226 X |
| 4,409,746 | 10/1983 | Beck | 37/58 |
| 4,601,612 | 7/1986 | Primrose | 405/226 |
| 4,830,541 | 5/1989 | Shatto | 405/226 |

FOREIGN PATENT DOCUMENTS

| | | | |
|---|---|---|---|
| 610869 | 4/1935 | Fed. Rep. of Germany . | |
| 1296695 | 5/1962 | France . | |
| 7908771 | 7/1981 | Netherlands . | |
| 8200866 | 10/1983 | Netherlands . | |
| 9975 | of 1843 | United Kingdom | 405/233 |

*Primary Examiner*—Dennis L. Taylor
*Assistant Examiner*—John A. Ricci
*Attorney, Agent, or Firm*—Brumbaugh, Graves, Donohue & Raymond

[57] ABSTRACT

Method and apparatus for lowering a heavy hollow column into hard soil and rock at the bottom of a body of water which column has a downwardly widening outer surface and a sharp lower edge. By means of plurality of suction nozzles erosive water flows are generated alongside and below the lower edge which sharp lower edge due to the erosive effect of the water flows and the local tensions generated in the soil by the weight of the column disintegrates the soil.

4 Claims, 2 Drawing Sheets

METHOD AND APPARATUS FOR PLACING A HOLLOW COLUMN IN THE HARD BOTTOM OF A BODY OF WATER IN PARTICULAR IN A ROCK BOTTOM

BACKGROUND OF THE INVENTION

The invention relates to a method of placing a column in the hard or rock like bottom of a body of water, said column having a sharp lower edge and a lower portion or foot which is widening downwardly by means of an inclined outer wall, and that after placing the column upon the bottom of the body of water the soil inside the inner wall of the column is removed.

An example of such a column is disclosed in the PCT application WO 87/03026 and it is known to work such a column, after placing it upon the bottom of the sea, into the bottom of the sea by its own weight and by removing soil material present inside the inner wall of the column by means of suction devices having cutters. Due to the fact that the column has a width which increases downwardly, friction of the soil around the outer wall of the column causes little or no problem. The removal of soil at the inner side however is less simple in particular in case said soil is hard, for instance comprises rock-like deposits. Rotating tools having cutting members wear quickly and cannot reach the stony or hard layer below the sharp lower edge. To bring such a column downwardly at the required depth accordingly creates a problem.

Purpose of the invention is to provide an improvement in this respect.

SUMMARY OF THE INVENTION

According to the invention this is achieved in that in the immediate vicinity of the inner side of the sharp lower edge of the column, in particular below the inner side of the foot, a strong suction is generated by means of at least one suction nozzle, which suction nozzle or nozzles is or are movable along the lower edge, such that erosion of the soil occurs along and below the sharp edge, due to which the soil material under the influence of the pressure of the sharp edge by the column on the soil and the erosive effect of the flows alongside and below the edge is disintegrated into small particles. In case a plurality of suction nozzles is used their adjacent working areas preferably overlap each other.

It is surprising that by this method even hard rock can be disintegrated including the removal of fine particles from air or gas containing voids within the rock structure.

Accordingly cutting tools no longer are applied. Lowering the column is based upon the effect of erosion generated by the flows which occur under the influence of the suction at the location of the sharp lower edge, in particular water flows or little flows, which penetrate from the outer side along the under side of said lower edge and flows respectively generated in the water present inside said wall by the suction, which water flows by said suction flow with high speed along the sharp lower edge, as well as upon the effect of the tensions generated by the sharp edge in the soil under the influence of the weight of the column. It is of importance therefore that the outer side of the column is not subjected to adhesive forces.

Surprisingly it appeared that in this way without cutting tools, a column of large dimensions can be lowered in a controlled manner. If the lowering slows down at one side with respect to the other side then the erosive effect is increased at the side which moves slowest. It is surprising as well that the hard layer is only disintegrated into small particles by the erosion, so that the suction nozzles do not get blocked. The erosion is stimulated by the fact that the sharp edge places the hard layer under high pressure. By the erosion and said pressure disintegration layer by layer and particle by particle takes place, in the main, although large chunks do come out from time to time. This might require adaptation of the size of the nozzle.

The sharp edge will try to penetrate into the soil by the weight of the column. Said soil is under very high pressure by said event because the sharp edge is not resting on the soil in an equally distributed way, certainly not in case the underground is very hard and for instance comprises rock. This means that close to the places or points of support of the sharp edge of the column flow of water can and will take place under the influence of the suction. This generates erosion, the sharp edge loses support, the tensions in the soil below said places which still support increase with the result of further disintegration of the soil.

It is observed that from French patent specification No. 1,296,695 it is known to remove soil by suction below the interior of a sharp edge of a column. However the outer wall of said column is vertical accordingly subjected to friction and adhesion which breaks the lowering. Moreover erosion does not take place because the soil inwardly of the sharp edge is fluidised by the supply of pressure water.

The invention now will be further elucidated with reference to the drawings.

DESCRIPTION OF THE PREFERRED EMBODIMENT

The drawings show a column 1 the inner and outer walls of which are made from steel plate and of which the interior of said wall is filled with concrete. Said column has been provided with a sharp lower edge 2 and is placed upon a hard bottom 3 of a body of water into which bottom the column has to be dug in.

Figure 1:
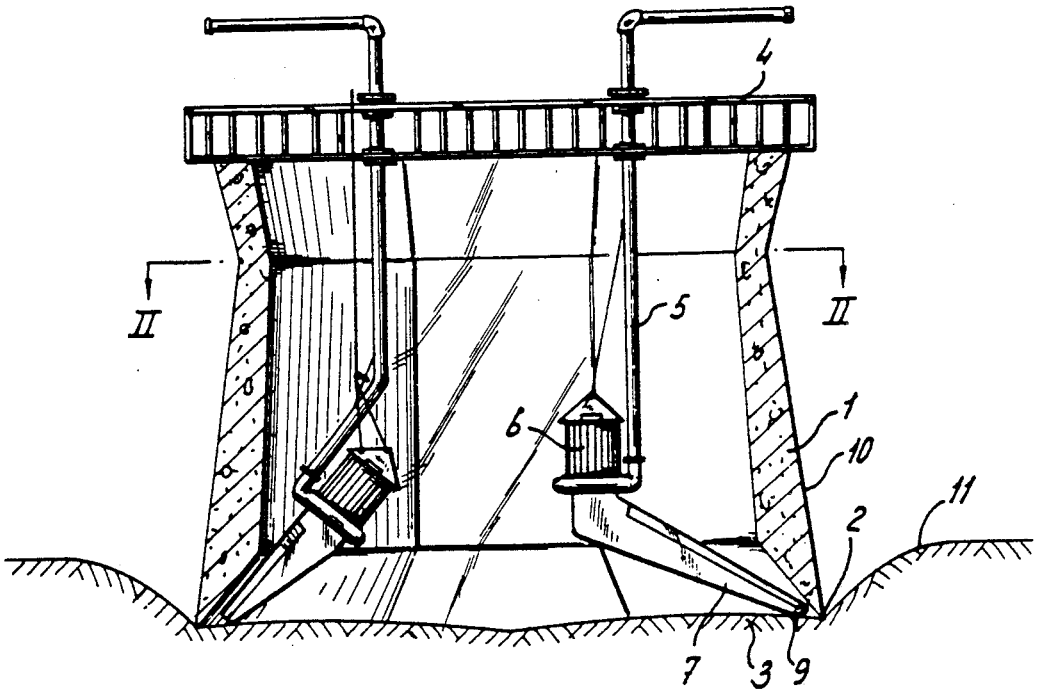
FIG. 1 diagrammatically shows in side view and section the principle underlying the present invention.
Figure 2:
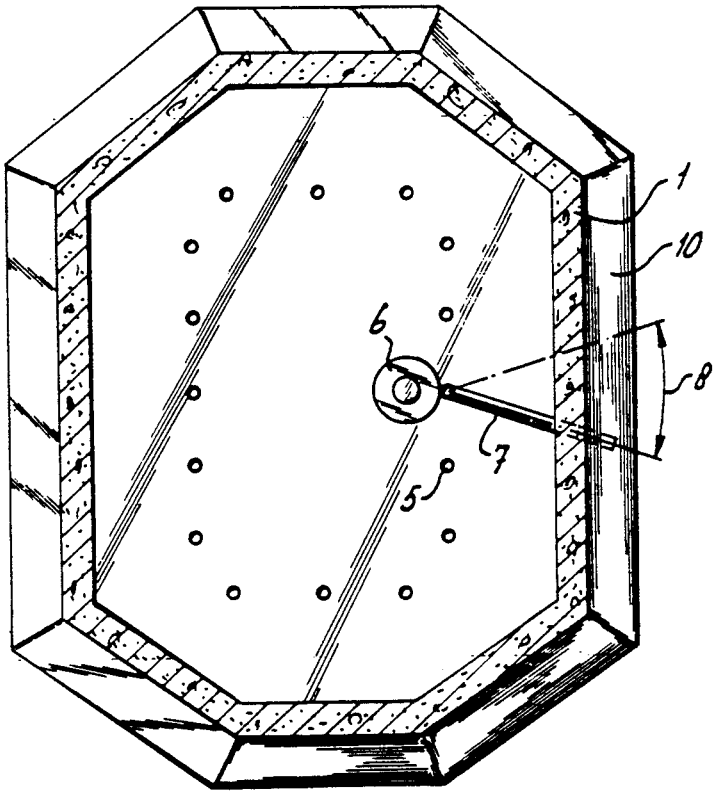
FIG. 2 is a horizontal cross section according to the line II—II of FIG. 1.

To obtain this a supporting structure 4 is placed upon the column from which are suspended one or more suction-pressure pumps 6 by means of cables. A number is diagrammatically indicated with circles 5 in FIG. 2.

Each pump has a pressure conduit and a suction conduit 7, which extends into the space located in the immediate vicinity of the sharp edge 2. Said suction conduit can be swung to and fro according to the curve 8 shown in FIG. 2, so that the working areas of the respective suction conduits overlap each other. The suction nozzles can be provided with a protective cage 9.

The inclined outer side 10 takes care that no friction can occur with the soil 11 present at the outer side of the column.

The soil inside the column is removed with the aid of the suction nozzles, which means by the erosion generated by said nozzles in corporation with the large pressure at the location of the sharp edge 2. Said removal usually will remain restricted to the area below the wall of the column. In the center an area of hard material will remain which however is no disadvantage, but more an advantage, because as soon as the column has reached the correct depth and after removal of the suction conduits the slot remaining inside the column then can be filled with underwater concrete.

Figure 3:
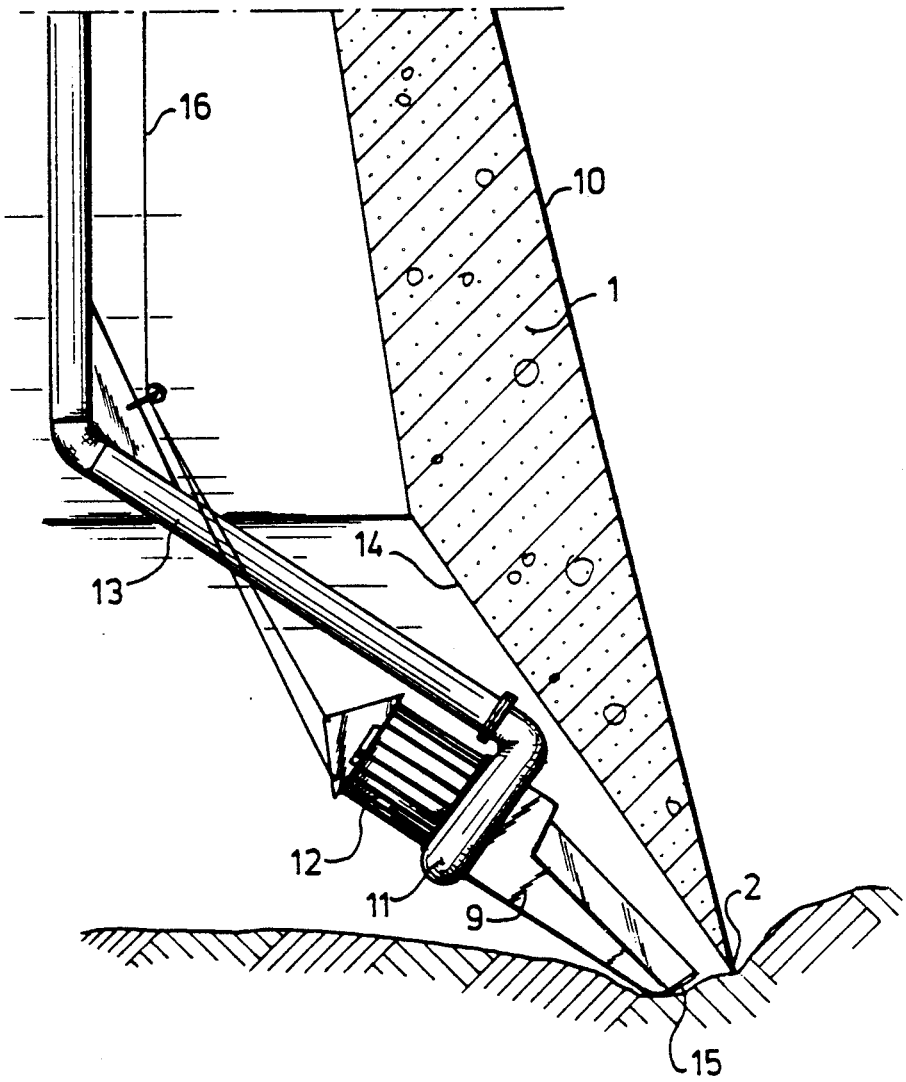
FIG. 3 shows at a larger scale the location of the suction nozzle in another embodiment.

FIG. 3 shows the lower edge 2 of column 1 at larger scale.

The suction nozzle 9 has a tapering shape and ends into a narrow inlet slot 15.

Said suction nozzle is attached to the pump housing 11 with motor 12 and rigidly attached to the rigid pressure conduit 13.

The conduit 13 with pump and suction nozzle extends into the space below the inner side 14 of the foot of the column with the suction nozzle 9 having its inlet 15 closely adjacent the lower edge 2.

Said inlet 15 may be slot-like but can be circular as well.

The pressure conduit is held in its place and controlled by means of for instance cables 16.

With the invention it turned out to be possible to place columns having a diameter of 14 meters into a soil consisting of volcanic rock.

I claim:

1. Method of lowering into the soil of the hard bottom of a body of water a hollow column having a downwardly widening lower portion which terminates in a sharp lower perimeteral edge which has been placed in contact with the bottom, comprising the steps of:

generating a strong suction immediately below the inner side of the sharp lower edge of the column and thereby causing water to flow below the sharp edge from alongside the outer side thereof, which together with the pressure exerted on the soil by the sharp edge due to the weight of the column, causes erosion of the soil along and below the sharp edge and disintegration of the soil into small particles, and removing the soil particles from the vicinity of the inner side of the lower edge and thereby allowing the column to be lowered by its own weight into the space created by removal of the eroded soil particles.

2. Method according to claim 1, wherein suction is generated by at least one suction nozzle which is or are movable along the inner side of the sharp lower edge.

3. Apparatus for lowering into the soil of the hard bottom of a body of water a hollow column having an upper end and a downwardly widening lower portion terminating at a lower end in a sharp lower perimeteral edge which has been placed in contact with the bottom, said apparatus comprising:

means including at least one rigid conduit supported on the upper end of said column and vertically oriented at a predetermined location inside said column, means including a suction-pressure pump supported at the lower end of said at least one conduit and communicating therewith, and a suction nozzle rigidly attached at an upper end to said pump and extending angularly downwardly and being so dimensioned as to position a lower end thereof close to the inner side of the sharp lower edge of the column, said apparatus being constructed and arranged for generating a strong suction immediately below the inner side of the sharp lower edge of the column to cause water to flow below the sharp edge from the outer side thereof and eroding and disintegrating the soil along and below the sharp edge into small soil particles and for removing the small soil particles.

4. Apparatus according to claim 3, wherein said apparatus comprises a plurality of vertically oriented conduits, each having an associated pump and suction nozzle, supported on the upper end of said nozzle and arranged in a pattern inside the column such that the lower end of each nozzle is positioned close to the inner side of the sharp lower edge of the column and the working areas of the nozzles overlap one another.

* * * * *